United States Patent [19]

Garcia

[11] 3,932,873

[45] Jan. 13, 1976

[54] SHORTENED APERTURE DIPOLE ANTENNA

[75] Inventor: Arthur Garcia, Woodbury, N.J.

[73] Assignee: RCA Corporation, New York, N.Y.

[22] Filed: Sept. 20, 1974

[21] Appl. No.: 507,708

[52] U.S. Cl. ..... 343/792; 343/802

[51] Int. Cl.[2] ..... H01Q 9/16

[58] Field of Search ..... 343/790–793, 343/752, 802, 828–830, 895

[56] References Cited

UNITED STATES PATENTS

| | | | |
|---|---|---|---|
| 3,048,845 | 8/1962 | Becker | 343/790 |
| 3,089,140 | 5/1963 | Monola | 343/752 |

FOREIGN PATENTS OR APPLICATIONS

| | | | |
|---|---|---|---|
| 840,850 | 7/1960 | United Kingdom | 343/895 |

*Primary Examiner*—Eli Lieberman

*Attorney, Agent, or Firm*—Edward J. Norton; Robert L. Troike

[57] ABSTRACT

A center fed dipole with a shortened aperture is described. A first rod-like radiator element approximately a quarter wavelength long at the center operating frequency of the antenna is coupled to the inner conductor of a coaxial transmission line. A second radiator element includes a hollow-conductive cylinder, coaxial with the coaxial transmission line, and a coil. The conductive cylinder is substantially less than a quarter wavelength long at the center operating frequency of the antenna. The conductive cylinder is coupled at one end to the outer conductor of the coaxial transmission line and the end of the cylinder remote from the one end is coupled to the coil.

7 Claims, 8 Drawing Figures

SHORTENED APERTURE DIPOLE ANTENNA

The invention herein described was made in the course of or under a contract or subcontract with the Department of the Navy.

BACKGROUND OF THE INVENTION

This invention relates to dipole antennas and more particularly to a shortened aperture, center fed dipole antenna that may be made flexible enough to be efficiently packaged for storing and erecting the antenna.

It is desirable in various applications that the physical length of a dipole antenna to be employed be shortened, for example, due to space requirements or other physical constraints. It is also desirable in many applications that a dipole antenna be flexible enough to be wrapped around a drum or the like for storing. In the prior art types of shortened aperture, center fed dipoles, one or more of the antenna radiating elements includes a coil or such loading means at or near the center feed point. This loading coil near the center feed point causes the magnitude of the antenna current to rapidly drop to essentially zero, resulting in the performance of the prior art shortened aperture dipole antenna to be substantially below that of the standard dipole.

According to the present invention, a shortened aperture, center fed dipole antenna system is provided by a coaxial transmission line, a radiator element connected to the inner conductor of the coaxial transmission line, and a second radiator element including the combination of a hollow conductor cylinder, coaxial with the coaxial transmission line, and a coil. One end of the conductive cylinder, which is substantially less than one quarter wavelength in physical length at the center operating frequency of the antenna, is coupled to the outer conductor of the coaxial transmission line, and the remote end of the cylinder is coupled to the coil.

DETAILED DESCRIPTION OF THE INVENTION

A more detailed description follows in conjunction with the following drawing wherein.

Figure 1:
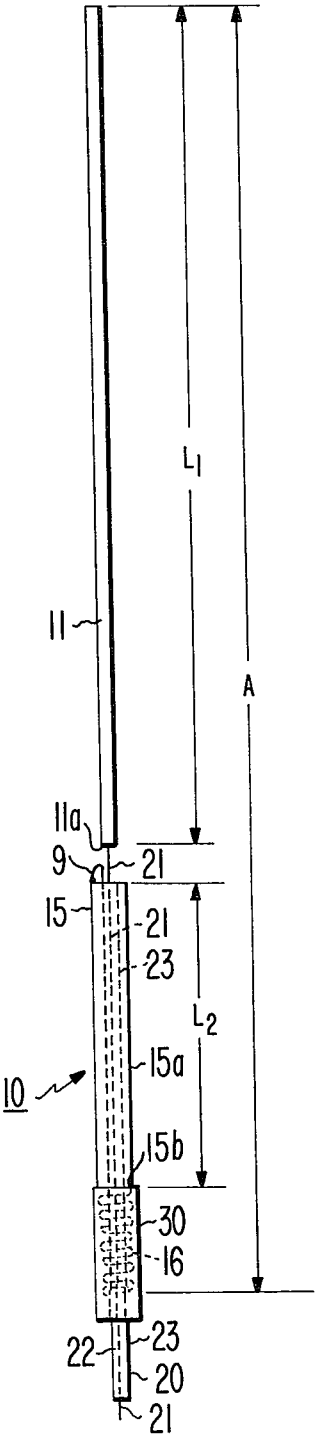
FIG. 1 is an elevation view of the antenna according to one embodiment of the present invention.
Figure 2:
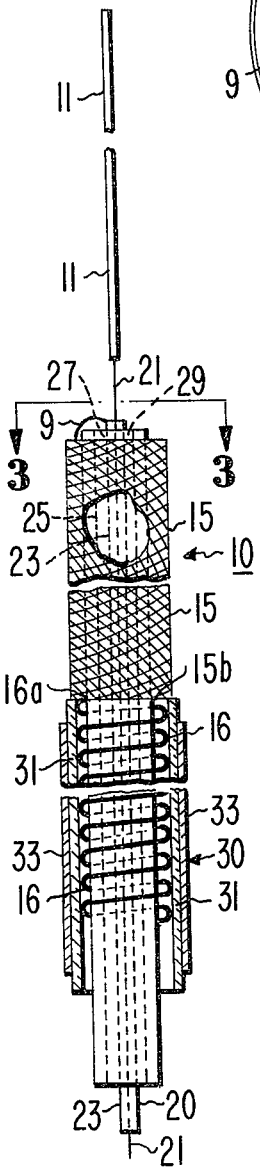
FIG. 2 is an expanded view of the antenna of FIG. 1 partly broken away.

Referring to FIGS. 1 and 2, there is illustrated a center fed dipole antenna 10. The dipole antenna 10 includes a narrow rod-like element 11 of conductive material, a coaxial conductive element 15 and an inductive spiral conductive element or coil 16. The rod-like element 11 is of a length L1 approximately one quarter wavelength long at the center operating frequency of the dipole antenna. The coaxial element 15 has a length L2, for example, on the order of 1/9th of a wavelength ($\lambda/9$) long.

Figure 3:
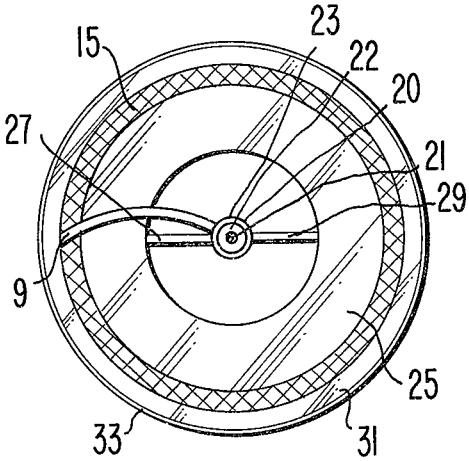
FIG. 3 is an expanded view of the coaxial element in FIG. 2 as viewed in the direction of arrows 3—3.

The antenna 10 is center fed by a 50 ohm coaxial transmission line 20 including an inner conductor 21 and an outer conductor 23 separated from each other by an insulator 22. See FIG. 3. The coaxial transmission line 20 extends coaxially through a hollow conductive cylinder 15*a* with the inner conductor 21 being connected to a feed point connection 11*a* at one end of the element 11. The outer conductor 23 of transmission line 20 extends coaxially through the hollow conductive cylinder 15*a* and forms with the conductive cylinder 15*a* the coaxial transmission line element 15. In order to make the antenna flexible, the conductive cylinder 15*a* is made of braided wires. The outer conductive cylinder 15*a* is joined with the outer conductor 23 of the inner coaxial transmission line 20 by a strap 9 at one end of the cylinder 15*a*, forming the second feedpoint of the antenna. As shown in FIGS. 2 and 3, the braiding making up the conductive cylinder 15*a* is wrapped or wound about a portion of a cylindrical member 25 of insulator material with dielectric spacers 27 and 29 centering the coaxial line 20 within the conductive cylinder 15*a* and cylindrical member 25. An air gap exists between the inner surface of cylindrical dielectric member 25 and outer conductor 23. The cylindrical member 25 of insulator material extends beyond the conductive cylinder 15*a* of braided wire. A coil 16 is connected at one end 16*a* to the end 15*b* of the conductive cylinder 15*a* remote from the end of the cylinder 15*a* connected to the outer conductor 23. The coil 16 is wrapped or wound around the cylindrical member 25 of insulator material. The dimension of the coil 16 is determined so that, with the coaxial conductive element 15, this combined element operates electrically as a quarter wavelength resonant structure although physically shortened to thereby provide a shortened aperture dipole.

An improved performance of the antenna has been achieved by a cylindrical sleeve 30 as shown in cross section in FIG. 2 spaced about the coil 16. The sleeve 30 is a cylinder 31 of dielectric material that extends the length of the coil 16 and has a conductive outside surface layer 33 that extends to about ¼ inch from the ends of the dielectric cylinder 31. The inner surface of sleeve 30 lies directly over the coil 16.

An antenna as discussed above made to operate at a center frequency of 304 MHz had the following dimensions:

Length of element 11 — (length L1) was 11 ¾ inch, dia. 0.047 inch semirigid wire.

Cylinder 15*a* — (length L2) was 4 ¼ inch long, braided wire 0.187 inch internal diameter.

Coil 16 was 8/10 inch long, diameter of coil 0.187 inch, pitch — 24 turns per inch, 17 turns, copper strap 0.020 inch wide and 0.002 inch thick.

Transmission line 20 was 50-ohm cable with outer conductor diameter of 0.035 inch; cable purchased as BTX-32-4050 from Berkshire Technical Products, Inc., Sinking Springs, Pa.

Cylinder 31 was about 1.24 inch long, outside diameter 0.234 inch, inside diameter about 0.187 inch, of a material sold as Rexolite NO. 1452 by Rexolite Corp., Division of Americal ENKA Corp., Willimantic, Conn. The cylinder 31 was covered with 0.0005 inch copper over 0.86 of an inch of its length to form conductive sleeve 30. This copper cover 33 begins about ⅛ inch below the braided wire. Dielectric constant of cylinder 31 material was about 2.

Cylindrical member 25 had a 0.187 inch outside diameter, grooved at the end to hold coil 16. Inside diameter was about 0.100 inch. The member 25 was made of a material sold under the name of Noryl by the Polymer Corp. of Reading, Pa. Dielectric constant was about 2.

Figure 4:
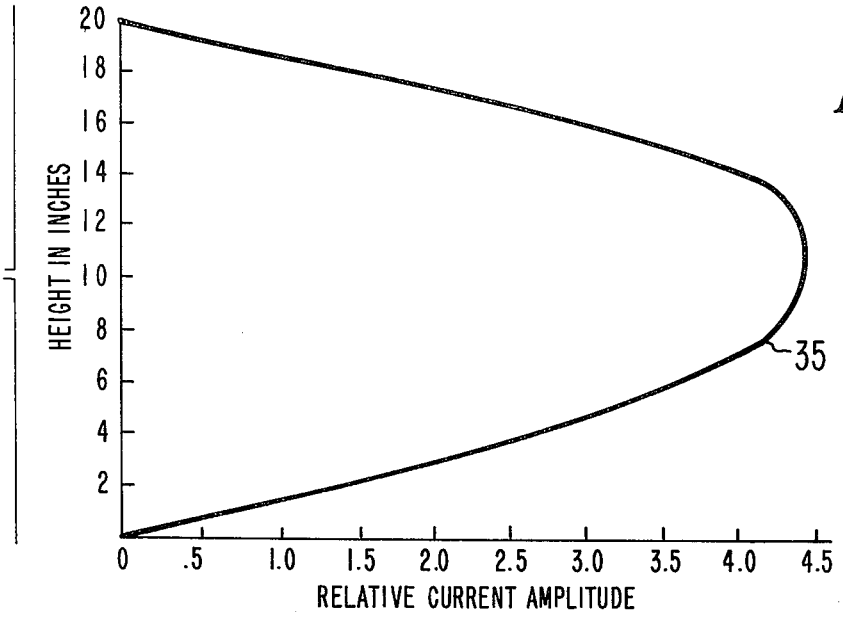
FIG. 4 is a plot of relative current amplitude vs. height for a standard reference dipole.
Figure 5:
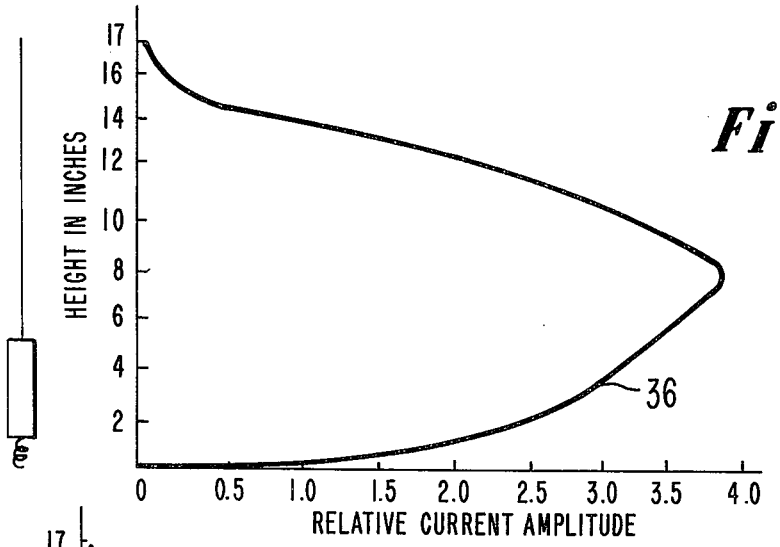
FIG. 5 is a plot of relative current amplitude vs. height for the dipole shown in FIGS. 1 thru 3 without a capacitive sleeve.
Figure 6:
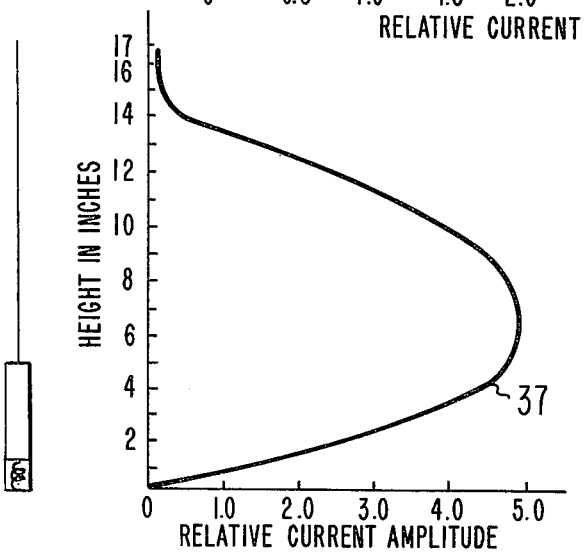
FIG. 6 is a plot of relative current amplitude vs. height for the dipole shown in FIGS. 1 thru 3 with a capacitive sleeve.

The efficiency of the above antenna was measured and compared with a standard dipole. Curve 35 in FIG. 4 is a plot of the relative current amplitude vs. height measured for a standard center fed dipole operating at about 304 MHz. The current amplitudes were measured by placing an R.F. coupling probe along the height of the antenna and by measuring the induced currents. The relative current amplitude values given on FIGS. 4 thru 6 are the actual value of the measured induced currents on the probe in milliamperes. Note in FIG. 4 that the maximum current is about a 4.5 level and this maximum level is near the center feed point. The overall height is 20 inches. Curve 36 in FIG. 5 illustrates the relative current amplitude vs. height of the antenna built as described above and shown in FIGS. 1 thru 3 without the sleeve 30 and operated at the same frequency as in FIG. 4. In applicant's arrangement discussed above, the current begins to drop off rapidly at the height where the coil 16 begins or at about 0.8 inches from the end. However, there is relatively high current along the coaxial element 15 (at heights 1 to 5 inches). Although the current maximum is not as great as that of a standard dipole, this dipole is only 17 inches long and does approach the current maximum of the longer standard dipole. The total area to the left of the curve in FIG. 5 is significantly greater than that exhibited by prior art shortened aperture dipoles. The antenna as described above provides operation with low VSWR (voltage standing wave ratio) to the 50 ohm transmission line over a fairly broad range of frequencies. For example, for a deviation of ±1 MHz from the center frequency at 304 MHz the impedance varied from $40 - j01$ to $52 + j8$. For a deviation of ±2 MHz, the impedance varied from $34 + j10$ to $45 + j10$. For a deviation of ±3 MHz, the impedance varied from $32 + j15$ to 30.

Curve 37 in FIG. 6 illustrates the relative current amplitude at the same frequency and for the same antenna described above with the sleeve 30 about the coil 16. As can be seen the current amplitude is greatly improved and its maximum even appears to be greater than that of a standard dipole. The area to the left of the curve is greater than without the sleeve 30 and approximately equals a standard dipole. An explanation for this follows. The current through the antenna elements is dependent upon the capacitance between the remote ends of these elements. A capacitance exists between the bare coil 16 and the element 11. By the addition of the conductive sleeve 30 and the coupling of high current thereto the sleeve presents a greater surface area than the coil causing increased capacitance between the conductive sleeve and the element 11. Also improved performance has been achieved by increasing the diameter of the coil 16. This latter arrangement may be further improved by a conductive sleeve as discussed above about this larger diameter coil.

Figure 7:
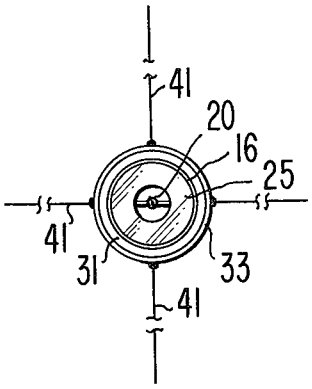
FIG. 7 is a bottom view of an antenna as shown in FIGS. 1 thru 3 with the addition of thin wire whiskers attached to a capacitive sleeve.
Figure 8:
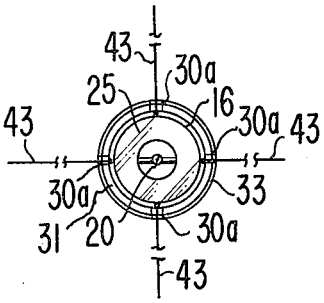
FIG. 8 is a bottom view of the antenna as shown in FIGS. 1 thru 3 with the addition of thin wire whiskers attached to the coil.

As shown in FIG. 7, improved current amplitude is possible by the use of four radially extending thin wire whiskers mounted on the outer conductive sleeve 30. These thin wire whiskers 41 are fixed at one end to the conductive surface 33 of sleeve 30 and extend orthogonal to the lengthwise axis of the sleeve about 1.5 to 2 inches. These whiskers 41 extend at 90° intervals. Also, improved performance has been achieved by four whiskers 43 extending at 90° intervals from coil 16 near the free end. These whiskers 43 extend radially as shown in FIG. 8. These whiskers 43 extend in this embodiment 1½ to 2 inches long. The sleeve 30 has four apertures 30*a* therein, and the whiskers 43 pass through these apertures to connect to the coil 16.

What is claimed is:

1. A center fed dipole antenna adapted to operate over a given range of frequencies comprising:

a coaxial transmission line, a first antenna radiator element connected at one end thereof to the inner conductor of said coaxial transmission line at an end of said coaxial transmission line, a second antenna radiator element including a hollow cylinder of conductive material and a coil, said hollow cylinder being coaxial with said coaxial transmission line and being electrically connected at an end to the outer conductor of said coaxial transmission line at said end of said coaxial transmission line, said cylinder being electrically connected at its other end to said coil and a cylindrical sleeve of conductive material spaced from said hollow cylinder and closely spaced coaxial with and about a substantial portion of said coil.

2. The combination claimed in claim 1 wherein said first radiator element is an elongated rod-like conductor.

3. The combination claimed in claim 1 wherein said first and second elements operate as quarter wavelength resonant elements.

4. The combination claimed in claim 1, including conductive whiskers extending orthogonally from said cylindrical sleeve.

5. The combination claimed in claim 1, including conductive whiskers extending orthogonal to said sleeve from said coil.

6. The combination claimed in claim 1 wherein said cylinder is made of braided wire.

7. The combination claimed in claim 1 wherein said cylinder is at least 1/9th wavelength long at a frequency within said given range of frequencies.

* * * * *